US007703242B2

(12) United States Patent
Goebel et al.

(10) Patent No.: US 7,703,242 B2
(45) Date of Patent: Apr. 27, 2010

(54) GUIDING SYSTEM FOR A SLIDING DOOR

(75) Inventors: Markus Goebel, Remscheid (DE); Ralf Duning, Solingen (DE)

(73) Assignee: Edscha AG, Remscheid (DE)

( * ) Notice: Subject to any disclaimer, the term of this patent is extended or adjusted under 35 U.S.C. 154(b) by 847 days.

(21) Appl. No.: 10/572,583

(22) PCT Filed: Sep. 17, 2004

(86) PCT No.: PCT/DE2004/002075

§ 371 (c)(1),
(2), (4) Date: Mar. 20, 2006

(87) PCT Pub. No.: WO2005/028794

PCT Pub. Date: Mar. 31, 2005

(65) Prior Publication Data

US 2007/0033877 A1 Feb. 15, 2007

(30) Foreign Application Priority Data

Sep. 20, 2003 (DE) ..... 103 43 717

(51) Int. Cl.
*E05D 13/00* (2006.01)

(52) U.S. Cl. ..... 49/425; 49/360; 16/92; 16/102; 16/106

(58) Field of Classification Search ..... 49/209, 49/213, 360, 425; 16/91, 102, 106; 296/155
See application file for complete search history.

(56) References Cited

U.S. PATENT DOCUMENTS

| | | | | | |
|---|---|---|---|---|---|
| 2,650,387 | A | * | 9/1953 | Foss | 16/91 |
| 4,064,590 | A | * | 12/1977 | Smith | 16/90 |
| 4,157,846 | A | * | 6/1979 | Whitcroft | 296/155 |
| 4,495,729 | A | * | 1/1985 | Britzke et al. | 49/212 |
| 4,530,184 | A | * | 7/1985 | Chikaraishi et al. | 49/213 |
| 4,559,740 | A | * | 12/1985 | Tuchiya et al. | 49/216 |
| 5,168,666 | A | * | 12/1992 | Koura et al. | 49/360 |
| 5,921,613 | A | | 7/1999 | Breunig et al. | 296/155 |
| 5,967,595 | A | * | 10/1999 | Heya et al. | 296/155 |

(Continued)

FOREIGN PATENT DOCUMENTS

DE 835 718 4/1952

(Continued)

*Primary Examiner*—Jerry Redman
(74) *Attorney, Agent, or Firm*—Davidson, Davidson & Kappel, LLC

(57) ABSTRACT

A guiding system for a sliding door, especially a motor vehicle, comprising a sliding rail (5) with an upper cover (6) and a lower edge (7) arranged opposite the upper cover (6), and a roller element (101) which is guided in the sliding rail (5) and comprises a roller element housing (102) is presented. Three rollers (103, 104) are rotatably fixed to the roller element housing (102), two rollers (103) extending along the upper cover (6) of the sliding rail (5) and the third roller (104) extending along the lower edge (7). The invention creates one such guiding system in such a way that there is no play, it operates quietly, and has a taut system characteristic. To this end, a spring element (109) is fixed to the roller element housing (102), said spring element pressing on of the first two roller (103) and the third roller (104) against the sliding rail (5).

15 Claims, 5 Drawing Sheets

U.S. PATENT DOCUMENTS

| | | | | |
|---|---|---|---|---|
| 5,974,738 | A * | 11/1999 | Jacobs | 49/425 |
| 6,286,260 | B1 * | 9/2001 | Grabowski | 49/216 |
| 6,328,374 | B1 | 12/2001 | Patel | 296/155 |
| 6,550,848 | B2 | 4/2003 | Kleemann | 296/155 |
| 6,779,832 | B2 * | 8/2004 | D'Assumcao | 296/155 |
| 7,159,930 | B2 * | 1/2007 | Yokomori et al. | 296/155 |

FOREIGN PATENT DOCUMENTS

| | | | |
|---|---|---|---|
| DE | 848 763 | | 9/1952 |
| DE | 6 806 861 | U | 4/1969 |
| DE | 44 46 403 | | 6/1996 |
| DE | 196 34 369 | C1 | 9/1997 |
| DE | 100 45 589 | A1 | 3/2002 |
| EP | 1 153 198 | A1 | 4/2003 |
| GB | 671 387 | | 5/1952 |
| GB | 2135724 | A * | 9/1984 |

* cited by examiner

Fig. 1
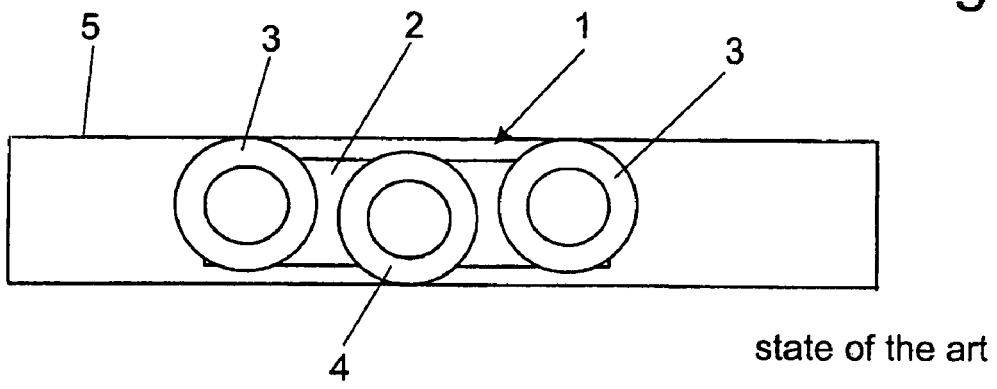
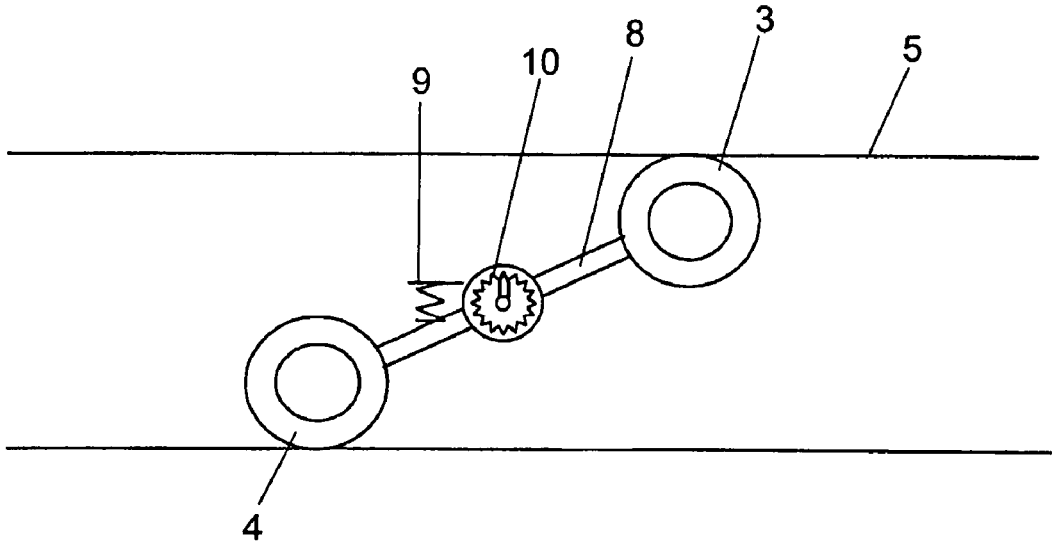
Fig. 2

GUIDING SYSTEM FOR A SLIDING DOOR

The invention relates to a guiding system for a sliding door, in particular for a motor vehicle comprising a runner rail with an upper cover and a lower termination arranged opposite the upper cover, a rolling element, with a rolling element housing being guided in the runner rail, three rollers being rotatably fastened to the rolling element housing with each of the three rollers being rotatable about a horizontal axis, a first roller and a second roller of the three rollers running along the runner rail against the upper cover and the third roller running along the runner rail against the lower termination.

BACKGROUND

Guiding systems of the as-cited type for sliding doors for vehicles and motor vehicles are known from the prior art. Guiding systems of this type have the disadvantage that the rolling elements in the guide rails have play and are thus not guided accurately, the operation rather causing undesired noise and not providing a taut system characteristic.

Guiding systems are known in which the runner rails are arranged either on the vehicle body or in the door and the rolling elements are correspondingly arranged in an opposite manner on the door or the vehicle body, for example on the door pillar.

DE 100 45 589 A 1 describes a guiding system for a sliding door in which a runner device arranged on the inside of the sliding door is guided in a guide rail fastened to the outer wall of the vehicle body. In this case, a horizontally mounted support roller of the runner device rests on the flat lower termination of the guide rail. Two vertically mounted guide rollers of the runner device are supported on the guide rail guide part which runs parallel to the rear wall, the guide part and rear wall being connected by means of a downwardly open V-shaped covering part. The sliding door system has a safety device, which functions by means of predetermined fracturing points, to prevent deformation as a result of accidents.

EP 1 153 198 A 1 describes a guiding system for a sliding door of a motor vehicle which comprises an upper runner rail and a lower runner rail. A rolling element designed as a carriage is guided in the lower runner rail, the rolling element having a plurality of upper and lower rollers, which respectively run along against an upper cover and a lower termination of the runner rail. In particular, two carriages each have two rollers with their axes horizontal and two rollers with their axes perpendicular to the current direction of movement of the carriage. Correspondingly, the upper runner rail has an upper carriage, to which upper and lower rollers are fastened and these respectively run along against the upper and lower duct section. The upper runner rail and the lower runner rail each have a C-shaped section, the upper runner rail however being arranged at 90° in relation to the lower runner rail. It is disadvantageous that the arrangement is susceptible to noisy operation, the rollers not being guided in an entirely accurate and taut manner. It is also disadvantageous that the rollers which are subject to wear over time lose contact with the runner rails and must then be adjusted by hand, which is complex, in order be able to lessen the noise of operation.

DE 6 806 861 U describes a guiding system for a sliding door of a motor vehicle which comprises an upperrunner rail and a lower runner rail. A first roller and a second roller are guided in the upper runner rail. The axes of the two rollers are connected permanently to a door but not to one another, so that the two rollers are not part of a rolling element, for example of a carriage. The first roller lies, in a closed position, in a first depression and the second roller in a second depression. If the door is moved, the first roller should in particular be prevented from running into the second depression which is assigned to the second roll, for which purpose a cylindrical axle bush is provided on the first roller and said axle bush interacts with an edge at the position of the second depression such that the axle bush is guided by the edge and the first roller does not run into the second depression. The arrangement in particular does not ensure that all of the rollers are in contact with an upper cover (upper rail) or a lower termination (lower rail) at all times. It is disadvantageous that the rollers have play which cannot be suppressed, so that operation of the sliding door is noisy.

DE 848 763 describes a guiding system for a sliding door of a motor vehicle, a first roller designed as a first guide roller and a second roller designed as a second guide roller being guided in a runner rail, which rollers are mounted on the two short arms of a T-shaped support lever. The long arm of the T-shaped support lever is fastened to the door by means of a bearing block. The two guide rollers are rotatable about a rotating pin. The lever arm of the support lever is loaded by a spring element in the form of a preloaded compression spring, the counterbearing of which is arranged in the bearing block. The compression spring loads the lever arm, and thus the two rollers which can be pivoted about the rotating pin, in such a way that the two rollers are constantly in contact with the limbs of the runner rails of U-shaped section. It is disadvantageous that the compression spring is fixedly connected to the door by means of the bearing block, and hence in particular cannot move with the two rollers along the runner rail. It is also disadvantageous that the overall construction is complex and is visually difficult to conceal. The construction relates in particular to the clamping of guide rollers, hence of rollers whose rotational axis is vertical, while the subject matter of the application is support rollers whose rotational axis is horizontal and in this case perpendicular to the instantaneous direction of movement of the respective rollers.

DE 196 34 369 C1 describes a guiding system for a sliding door of a motor vehicle which comprises a runner rail in which two rollers are guided, the rolling axes of which are horizontal and perpendicular to the instantaneous direction of movement. The two rollers are fastened to a rolling element designed as a carriage. The two rollers both run against a lower termination of the guide rail. A closing roller with a perpendicular rolling axis is also attached to the carriage, which closing roller engages in a closing groove. It is disadvantageous that the carriage in the runner rail has play so that it is not guided in a secure and taut manner.

DE 835 718 B describes a mounting for rolling elements, in particular of spheres and cylindrical rollers, which are guided along a runner rail and are held in a further rail, the bearing rail. The rolling elements designed as cylindrical rollers are supported by means of a perforated tape and loaded by means of springs. It is disadvantageous that the rolling elements have play which cannot be eliminated and which directly prevents a taut guidance of the sliding door. It is also disadvantageous that the arrangement is of very complex design.

SUMMARY OF THE INVENTION

It is the object of the invention to further develop the guiding system for a sliding door described in the introduction such that it is designed to be free of play, make as little noise as possible and have a taut system characteristic.

This object is achieved according to the invention by means of a guiding system for a sliding door having a spring element being fastened to the rolling element housing, the spring element loading one of the first roller and the second roller as well as the third roller against the runner rail and a fork being coupled to the rolling element housing so as to be rotatable about a horizontal axis, and a return stop coupled to the rolling element, the return stop suppressing the rotation of the fork about a vertical axis of the fork.

The guiding system has the advantage of achieving freedom of play, lack of noise and a taut system characteristic using simple means.

It is also advantageous that the three rollers which constantly bear against the guide rail represent a secure and stable three-point bearing.

A particular advantage is that the rollers are self-centering within their runner tracks and that freedom of play is permanently ensured in that an upper and a lower roller are preloaded against one another and are pressed against their respective rolling track, since both production tolerances and wear-related tolerances are automatically compensated for by means of readjustment. If two rollers are coupled to one another by means of a fork, a blockage of the fork rotation in the direction opposed to the preload is advantageously avoided by means of locking, so that the preload is constantly held at a certain minimum level.

An embodiment in which a further upper roller is aligned with the first in the rolling element ensures, by means of the three-point support, stable guidance of the rolling element and a sufficient stiffness of the rolling element in the running direction. The provision of an insertion opening, by means of which the rolling element with the rollers which are preloaded against one another and thus forced apart in the vertical direction can be inserted into the runner rail, has the advantage that the prestress can be deliberately built up in steps with a small gradient up to the initial position.

In rail systems which have, in addition to a straight section, at least one curved section, the guidance through the curved section can be ensured either by correspondingly widening the V-section or by designing at least one roller to be pivotable about a perpendicular axis. This must be provided at least for the embodiment in which two aligned upper rollers being arranged one behind the other are provided. This can however also be necessary if the prestress is so high that the individual roller is so closely fitted along both sides of its contact line with the inclined V-faces that the longitudinal extent of the roller must be adapted to the curved track.

BRIEF DESCRIPTION OF THE DRAWINGS

The invention will be described in more detail in the following on the basis of preferred exemplary embodiments and with reference to the enclosed drawings.

FIG. 1 shows a schematic side view of a guiding system having a rolling element comprising three rollers in a runner rail, as is known from the prior art;

FIG. 2 shows a schematic side view of a detail with two rollers, prestressed against one another, of a rolling element of a first exemplary embodiment of a guiding device according to the invention;

DETAILED DESCRIPTION

Figure 2A:
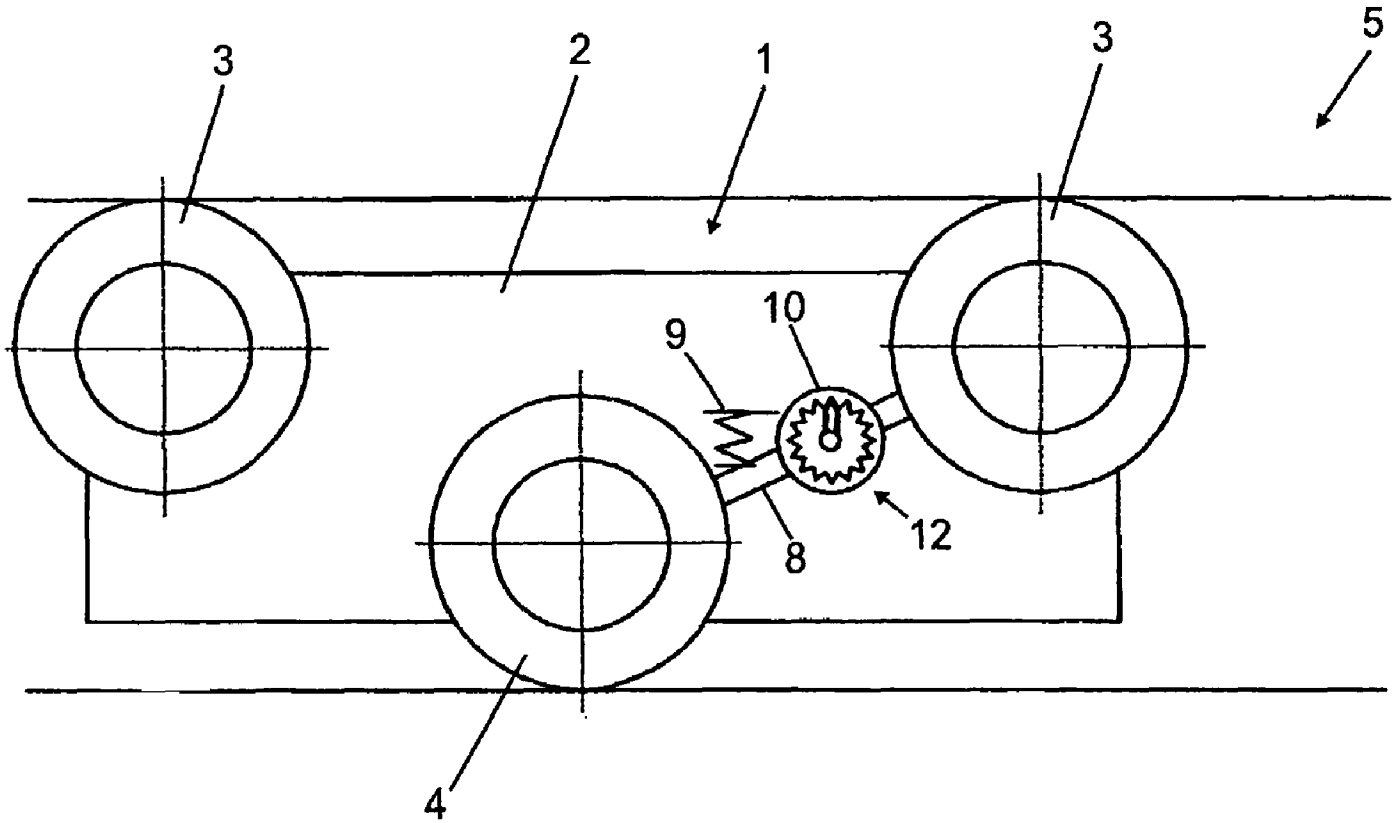
FIG. 2*a* shows a schematic of the first exemplary embodiment from FIG. 2 together with the rolling element housing.

FIG. 1 schematically illustrates how a rolling element 1 designed as a carriage, with three rollers offset in relation to one another, of which two upper rollers 3 bear against the upper cover 6 and a lower roller 4 bears against the lower termination 7 of the runner rail 5, is guided. The three rollers 3, 4 are mounted so as to be rotatable about horizontal axes on a rolling element housing 2. It can be seen that this form of offset arrangement of upper rollers 3 and lower roller 4 allows a stable three-point support. The stiffness in the longitudinal direction necessary for a taut system characteristic is also favourably influenced by the aligned arrangement of the upper roller 3. Such guiding systems are known from the prior art but require a constant readjustment of the setting of the rollers 3, 4 in order to ensure a secure operation of the rolling element 1.

In FIG. 2, only one of the upper rollers 3 and the lower roller 4 are illustrated, and these are connected to one another by means of a fork 8. The fork 8, designed as a rocker, is mounted on the rolling element housing 2 (not illustrated) so as to be rotatable about a horizontal axis and is prestressed in this case by means of a spring element 9. A return stop 12 in the form of an annular locking element 10 is arranged on the fork axis. It is to be understood that this form of prestressing and return stop 12 can also be implemented in the case of rolling elements 1 with three rollers as shown in FIG. 1. The prestressing of the rollers against one another can be effected in other ways such as for example by means of eccentrics.

FIG. 2*a* shows the rolling element 1 from FIG. 2 with the two upper rollers 3 and the lower roller 4, where it can be seen that the spring element 9 is designed as a spiral spring, the first end of which engages on the rolling element housing 2 and the second end of which engages on the fork 8 designed as a rocker in such a way that the spring element 9 rotates the rocker anticlockwise, one of the upper rollers 3 and the lower roller 4, which are coupled to one another by means of the rocker, being pressed against the runner rail 5. A return stop 12 prevents a movement of the fork 8 counter to the prestress of the fork 8 by the spring element 9.

Figure 2B:
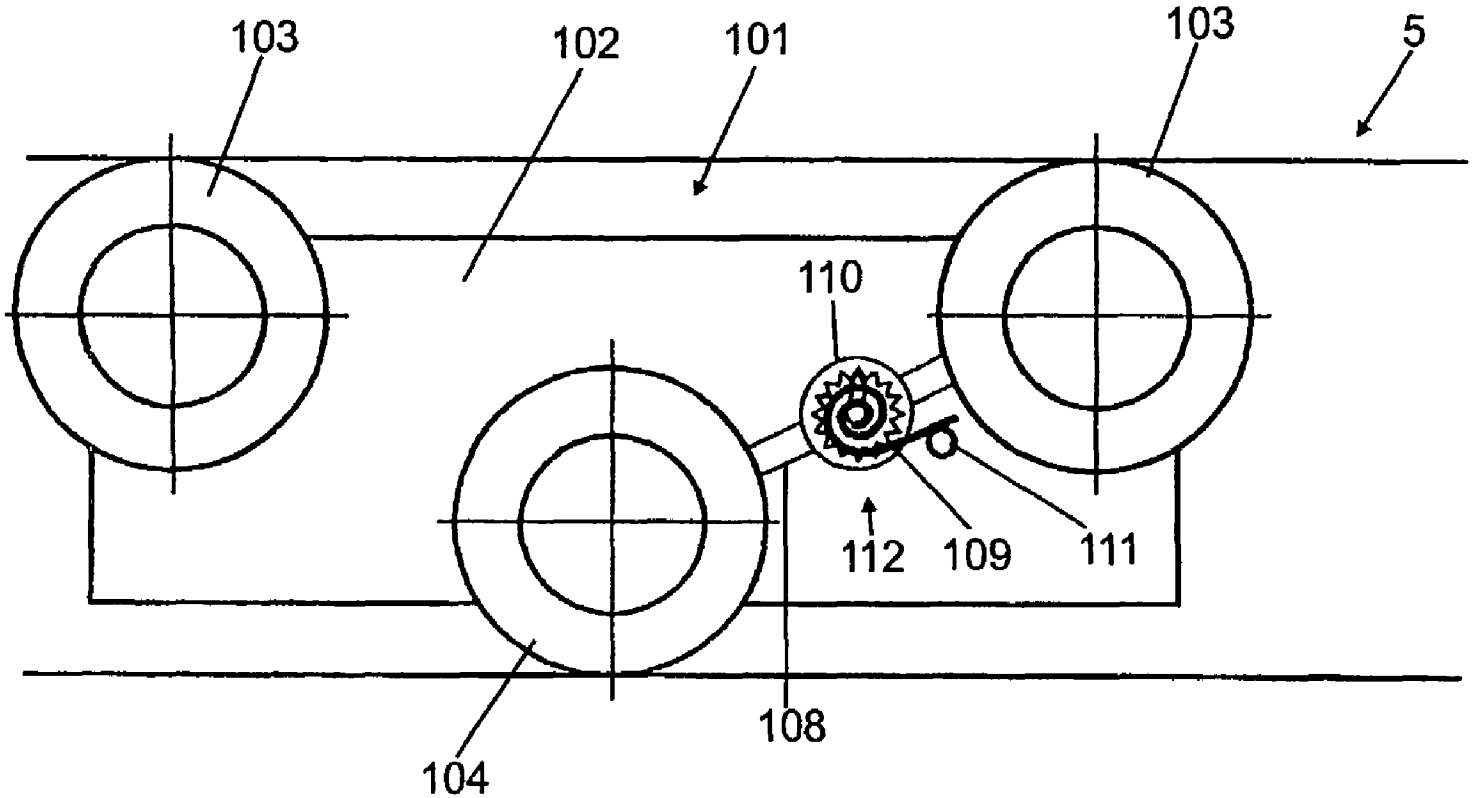
FIG. 2*b* shows a schematic of a second exemplary embodiment of a guiding device according to the invention.

FIG. 2*b* shows a rolling element 101 designed as a carriage with two upper rollers 103 and a lower roller 104, one of the upper rollers 103 and the lower roller 104 being coupled to one another by means of a fork 108 designed as a rocker. The fork 108 is rotatably attached to the rolling element housing 102. A spring element 109 is designed as a leg spring and engages on an axle of the fork 108 in such a way that the fork 108 and thus the rollers 103 and 104 coupled to the fork 108 are rotated counterclockwise and are pressed against the runner rail 105. The spring element 109 is supported on a pin 111 arranged on the rolling element housing 102. The fork 108 is assigned a return stop 112 which comprises an annular locking element 110.

Figure 2C:
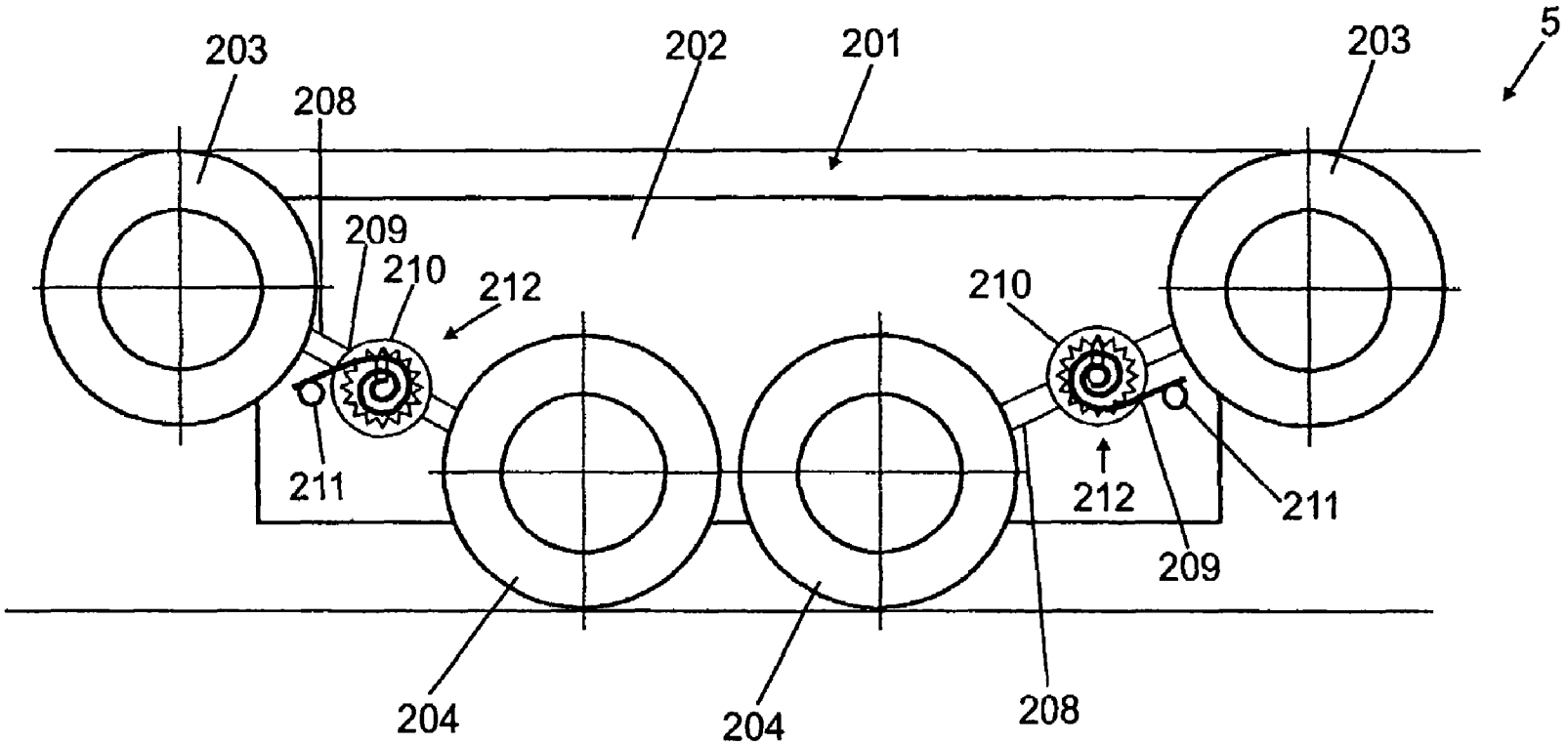
FIG. 2*c* shows a schematic of a third exemplary embodiment of a guiding device according to the invention.

FIG. 2*c* shows a rolling element 201 designed as a carriage with two upper rollers 203 and two lower rollers 204, which form two roller pairs, the respective upper roller 203 being connected to the respective lower roller 204 for each roller pair by means of a fork 208 designed as a rocker. The respective fork 208 is rotatably coupled to the rolling element housing 202. Each fork 208 is loaded by a spring element 209 designed as a leg spring, the respective spring element 209 being supported against pins 211 arranged on the rolling element housing 202. Each fork 208 is assigned a return stop 212 which comprises an annular locking element 210.

Figure 3:
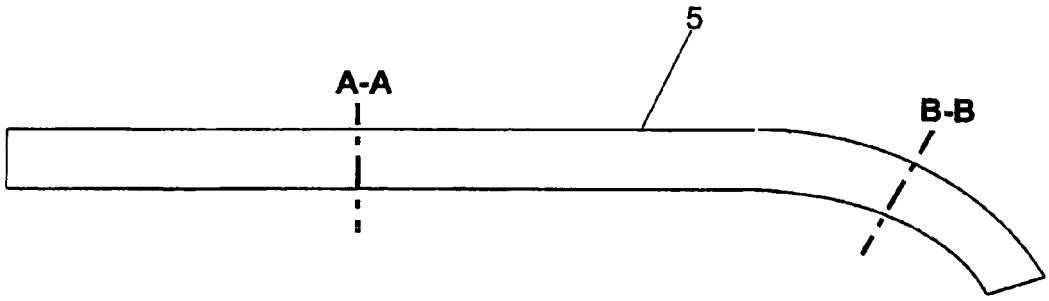
FIG. 3 shows a schematic plan view of a runner rail with a straight section and a curved section.

FIG. 3 illustrates a schematic plan view of a runner rail 5 with a straight section and a curved section.

Figure 3A:
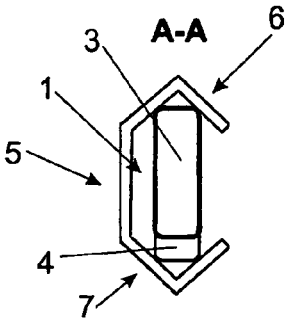
FIG. 3*a* shows a cross-section through the runner rail with a rolling element along the section A-A in FIG. 3.

FIG. 3*a* illustrates the cross-section in accordance with A-A in FIG. 3 through the runner rail, in which a rolling element 1 (101, 201) is guided in the straight section. In this case, the rollers 3, 4 (103, 104) bear against the respective inclined faces in a punctiform manner, so that linear rolling tracks result and the rollers are self-centering within their runner tracks.

Figure 3B:
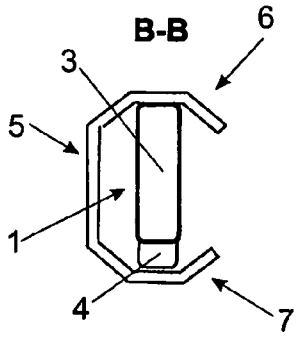
FIG. 3*b* shows a cross-section through the runner rail with a rolling element in accordance with section B-B in FIG. 3.

FIG. 3*b* illustrates a cross-section through a runner rail 5, in which a rolling element 1 (101, 201) is guided in a curved section of the runner rail 5 in accordance with section B-B in FIG. 3. It can be seen that the inclined faces are at a greater distance from one another than in the straight section of the runner rail 5 shown in FIG. 3*b*. In this embodiment, the freedom of play in the straight sections is ensured. In the curved section of the runner rail 5, there is very little play since the rollers 3, 4 (103, 104; 203, 204) are prevented from greater movement by the inclined faces.

Figure 4:
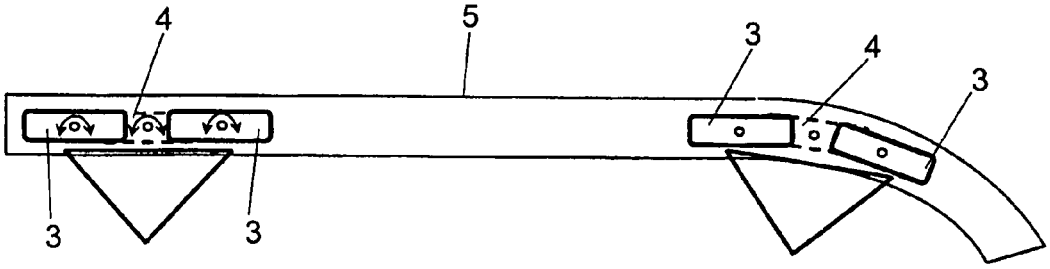
FIG. 4 shows a schematic plan view of a runner rail with two rolling elements guided therein and having three rollers mounted so as to be pivotable about a vertical axis.

FIG. 4 is a schematic plan view of a runner rail 5 in which a rolling element 1 (101,201), with three rollers 3, 4 (103,104) or four rollers 203,204 mounted so as to be pivotable about a vertical axis, is guided both in the straight section and the curved section.

The embodiments illustrated in FIGS. 3*b* and 4 are alternatives for runner rails 5 with curved sections. In this case, rolling elements with rollers 3, 4 (103, 104; 203, 204) which are pivotable about a vertical axis can also be implemented in runner rails in accordance with FIG. 3*b*.

What is claimed is:

1. A guiding system for a sliding door, in particular of a motor vehicle, the guiding system comprising a runner rail with an upper cover and a lower termination arranged opposite the upper cover, a rolling element with a rolling element housing being guided in the runner rail, three rollers being rotatably fastened to the rolling element housing, with each of the three rollers being rotatable about a horizontal axis, a first roller and a second roller of the three rollers running along the runner rail against the upper cover and the third roller running along the runner rail against the lower termination, a spring element being fastened to the rolling element housing, the spring element loading one of the first roller and the second roller as well as the third roller against the runner rail, and a fork being coupled to the rolling element housing so as to be rotatable about a horizontal axis, and a return stop coupled to the rolling element, the return stop suppressing the rotation of the fork about the horizontal axis of the fork.

2. The guiding system as recited in claim 1, wherein one of the first roller and the second roller as well as the third roller is fastened to the fork, and wherein the spring element engages on the fork in such a way that it rotates the fork about the horizontal axis of the fork.

3. The guiding system as recited in claim 1, wherein at least one of the three rollers is pivotable about a vertical axis.

4. The guiding system as recited in claim 1, wherein the first roller and the second roller are aligned in the linear direction of movement.

5. The guiding system as recited in claim 1, wherein the runner rail has a straight section, and wherein one of the upper cover and lower termination has a V-shaped section in the straight section of the runner rail.

6. The guiding system as recited in claim 1, wherein the runner rail has a curved section, and wherein one of the upper cover and lower termination has a trough-shaped section in the curved section of the runner rail.

7. The guiding system as recited in claim 1, wherein the runner rail has, at least at one end, an insertion opening for the rolling element, and wherein the insertion opening widens in the horizontal direction with a small gradient.

8. The guiding system as recited in claim 1, wherein the runner rail is provided in one part with the upper cover and the lower termination and substantially approximately encloses the movement track of the rolling element on three sides.

9. A guiding system for a sliding door, in particular of a motor vehicle, the guiding system comprising a runner rail with an upper cover and a lower termination arranged opposite the upper cover, a rolling element with a rolling element housing being guided in the runner rail, three rollers being rotatably fastened to the rolling element housing, with each of the three rollers being rotatable about a horizontal axis, a first roller and a second roller of the three rollers running along the runner rail against the upper cover and the third roller running along the runner rail against the lower termination, a spring element being fastened to the rolling element housing, the spring element loading one of the first roller and the second roller as well as the third roller against the runner rail, wherein at least one of the three rollers is pivotable about a horizontal axis, wherein a fork is coupled to the rolling element housing so as to be rotatable about a horizontal axis, wherein one of the first roller and the second roller as well as third roller is fastened to the fork, and wherein the spring element engages on the fork in such a way that it rotates the fork about the horizontal axis of the fork.

10. The guiding system as recited in claim 9, wherein the rotation of the fork about the horizontal axis of the fork is suppressed by means of a return stop.

11. The guiding system as recited in claim 9, wherein the two first roller and the second roller are aligned in the linear direction of movement.

12. The guiding system as recited in claim 9, wherein the runner rail is provided with a straight section, and wherein one of the upper cover and lower termination has a V-shaped section in the straight section of the runner rail.

13. A guiding system for a sliding door, in particular of a motor vehicle, the guiding system comprising a runner rail with an upper cover and a lower termination arranged opposite the upper cover, a rolling element with a rolling element housing being guided in the runner rail, three rollers being rotatably fastened to the rolling element housing, with each of the three rollers being rotatable about a horizontal axis, a first roller and a second roller of the three rollers running along the runner rail against the upper cover and the third roller running along the runner rail against the lower termination, a spring element being fastened to the rolling element housing, the spring element loading one of the first roller and the second roller as well as the third roller against the runner rail, wherein at least one of the three rollers is pivotable about a horizontal axis, wherein the runner rail has, at least at one end, an insertion opening for the rolling element, and wherein the insertion opening widens in the horizontal direction with a small gradient.

14. The guiding system as recited in claim 13, wherein the runner rail is provided with a curved section, and wherein one of the upper cover and lower termination has a trough-shaped section in the curved section of the runner rail.

15. The guiding system as recited in claim 13, wherein the runner rail is designed in one part with the upper cover and the lower termination and substantially approximately encloses the movement track of the rolling element on three sides.

* * * * *